United States Patent [19]

Malkki

[11] Patent Number: 4,987,759

[45] Date of Patent: Jan. 29, 1991

[54] MACHINE FOR MANUFACTURING HELICALLY-SEAMING TUBING

[75] Inventor: Kalervo Malkki, Helsinki, Finland

[73] Assignee: Tuotekolmio Oy, Finland

[21] Appl. No.: 479,400

[22] Filed: Feb. 13, 1990

[30] Foreign Application Priority Data

Feb. 17, 1989 [FI] Finland ..... 890784

[51] Int. Cl.[5] ..... B21C 37/12

[52] U.S. Cl. ..... 72/49

[58] Field of Search ..... 72/49, 50, 135, 138; 228/145, 146, 147, 17.7

[56] References Cited

U.S. PATENT DOCUMENTS

| | | | |
|---|---|---|---|
| 1,939,581 | 12/1933 | Tesmer | 72/49 X |
| 2,862,469 | 12/1958 | Jensen | 72/49 |
| 3,229,487 | 1/1966 | Jensen | 72/50 |
| 3,393,546 | 7/1968 | Fay | 72/49 |
| 3,614,882 | 10/1971 | Malkki et al. | 72/50 |

FOREIGN PATENT DOCUMENTS

| | | | |
|---|---|---|---|
| 737238 | 6/1966 | Canada | 72/49 |
| 794299 | 4/1958 | United Kingdom | 72/49 |

*Primary Examiner*—E. Michael Combs
*Attorney, Agent, or Firm*—Steinberg & Raskin

[57] ABSTRACT

The invention relates to a machine for manufacturing helically-seamed tubing from a strip-like profiled blank (11*a*), in which machine the strip-like profiled blank is guided to travel under positive guidance into a tubular shape (11) (FIG. 2) over a distance corresponding to the pitch of a helical seam, whereupon the edges of the profiled blank brought into jointing contact are seamed together by using at least two seaming rolls (15, 16) one of which (15) is inside the tube (11) being formed and the other (16) outside it. In the machine the positive guidance of the profiled blank (11*a*) is accomplished by a loop, adjustable in size and formed of a chain-type traction member (14), inside which loop the strip-like profiled blank (11*a*) is adapted to be positively fed. One of the traction members (14) constituting the loop is attached to a rocker (22) (FIG. 3*a*, 3*b*), which rocker (22) is provided with an adjusting member or adjusting members (29) for guiding the profiled blank (11*a*) to the point of seaming. The traction member (14) is attached at the other end thereof to a gearbox (23), by means of which gearbox (23) and a gear member (24) connected thereto the traction member (14) can be tightened, whereby a narrowing portion, which is preferably conical, can be produced in the tube on the basis of the control of the machine. The tube (11) can be positioned in the center of seaming by means of the gearbox (23) and a support (25) thereof.

7 Claims, 3 Drawing Sheets

MACHINE FOR MANUFACTURING HELICALLY-SEAMING TUBING

BACKGROUND OF THE INVENTION

The invention concerns a machine for manufacturing helically-seamed tubing from a strip-like profiled blank, in which machine the strip-like profiled blank is guided to travel under positive guidance into a tubular shape over a distance corresponding to the pitch of a helical seam, whereupon the adjacent edges of the profiled blank brought into jointing contact are seamed together by using at least two seaming rolls, one of which is inside the tube being formed and the other outside it, and in which machine the positive guidance of the profiled blank into a helical shape is accomplished from the outside thereof by a loop, adjustable in size and formed of a chain-type traction member, inside which loop the strip-like profiled blank is adapted to be positively fed, in which one end of the traction member constituting the loop is attached to a rocker.

A number of different machines operating on different principles are previously known by means of which helically-seamed tubing can be produced. The most prevalent machines are of the kind in which a pre-profiled metal strip is fed upon a cylindrical mandrel piece and the finishing of a seam is then accomplished by means of various kinds of seaming rolls. In these prior art machines the axis of the mandrel forms a given angle with the pre-profiled strip, the magnitude of which angle is mainly determined as a function of the strip width employed and the inside diameter of the tubing to be manufactured.

In other previously-known types of machine a mandrel or equivalent workpiece is not used, but, instead, a pre-profiled strip is positively fed into a stationary shaped piece which conforms to the external shape of tubing and incorporates contact surfaces. When advancing along the contact surfaces, the pre-profiled strip is forced to bend into a tubular shape, and the seam ends are brought into contact with each other and seamed to form a finished seam by means of rotating seaming rolls.

Among the drawbacks of previously-known machines is that in their storage inventory a large number of different tool units have to be stored, which have to be replaced each time that the strip width or type used is changed to another or when the diameter of the tubing to be made changes. Such tool units are difficult to manufacture and their manufacturing is quite expensive, which implies that in versatile production a considerable amount of capital has to be tied up in them. On the other hand, they tend to wear down, because, when gliding along the guiding surfaces provided in them, the tubing being formed wears them down at a relatively fast rate, which very soon leads, among other things, to the fact that the actual measured tolerances and the appropriate tolerances in view of quality change in an unfavorable direction, and the quality of the tubing, e.g., the tightness of the helical seam, deteriorates.

A previously-know apparatus for solving the above-mentioned problems is disclosed in FI Pat. No. 45 418. The machine of this prior art apparatus chiefly belongs to the latter group of the above-mentioned machine types. In this prior art apparatus, adjustment of an outside diameter of the tubing to be helically seamed is achieved by means of a flexible traction member.

SUMMARY OF THE INVENTION

An object of the invention is to develop further the apparatus disclosed in the above-mentioned publication in such a manner that the machine according to the invention reducing the wear of a traction member and increasing the efficiency of its operativeness can be achieved. A further object of the invention is to increase further the efficiency of the machine intended for the manufacturing of the tubing to be helically seamed.

With a view to achieving the above-noted objects as well as those described hereinafter, the machine according to the invention is mainly characterized in that the rocker is provided with an adjusting member or adjusting members for guiding the profiled blank to the point of seaming, and that the traction member is connected at the other end thereof to a gearbox, by means of which gearbox and a gear member connected thereto the traction member can be tightened, whereby a narrowing portion, which is preferably conical, can be produced in the helical seam tube on the basis of the control of the machine, and that the tube can be positioned in the center of seaming by means of the gearbox and a support connected thereto.

The machine according to the invention has no such parts highly susceptible to wear which would often have to be changed for new ones or have to be replaced because of deterioration of quality. In the machine of the invention no such tool units are used, either, the manufacture of which would require high accuracy and usually machine tools. In the machine according to the invention a flexible chain is used as a traction member, this chain being of low friction and suitably shaped to improve the manufacture of the tubing to be helically seamed and, at the same time, to increase the efficiency of the operation of the machine. Moreover, the chain component in the construction according to the invention is easy to replace, so that its possibly wearing out does not cause any problems.

The machine according to the invention is very suitable for use at the location of the object for which the tubes to be helically seamed are intended; in other words, it is taken directly to the work location, and the manufacture of tubing is carried out there, thus avoiding high transport costs which usually encumber tube goods, especially if the diameter of the tubes is large.

BRIEF DESCRIPTION OF THE DRAWINGS

The invention is described in greater detail hereinafter with reference to the Figures of the accompanying drawing, in which

In FIGS. 1 and 2 the reference numeral 10 designates the body of the machine, outside which are situated the members participating in the seaming operation. A smooth metal strip blank 11 passes through profiling rolls 12, imparting a desired profile to the blank 11*a*. At the same time, the profiling rolls 12 feed the metal strip blank 11*a* forwards between guide blocks 13. In an intermediate space 21 of the guide blocks 13 there are different ridges and/or grooves conforming to the profile of the strip so that the metal strip blank 11*a* advances under positive guidance at this stage, too, so that it cannot turn to either side or upwards or downwards. On release from the positive guidance by the guide blocks 13, the metal strip blank 11*a* encounters, in the embodiment of the invention described here, a support 9, which is an annular rigid positive guidance member constituting a single helical position, i.e., a distance corresponding to the pitch of a single helix, and being slightly larger than the varying diameter of the conical portion at the tube to be manufactured. The support 9 guides the metal strip blank from the outside thereof up to the point of seaming, bending the blank so as to form a helical ring. At the same time the traction member 14 functions as an outside loop which determines the outside diameter of the tube being formed which diameter is constant beyond the first helix. The support 9 guides the blank only during the forming of the first helix, and after that the guidance of the blank is accomplished through the traction member 14. The support 9 is used when manufacturing pieces of tubing comprising a conical portion.

Figure 1:
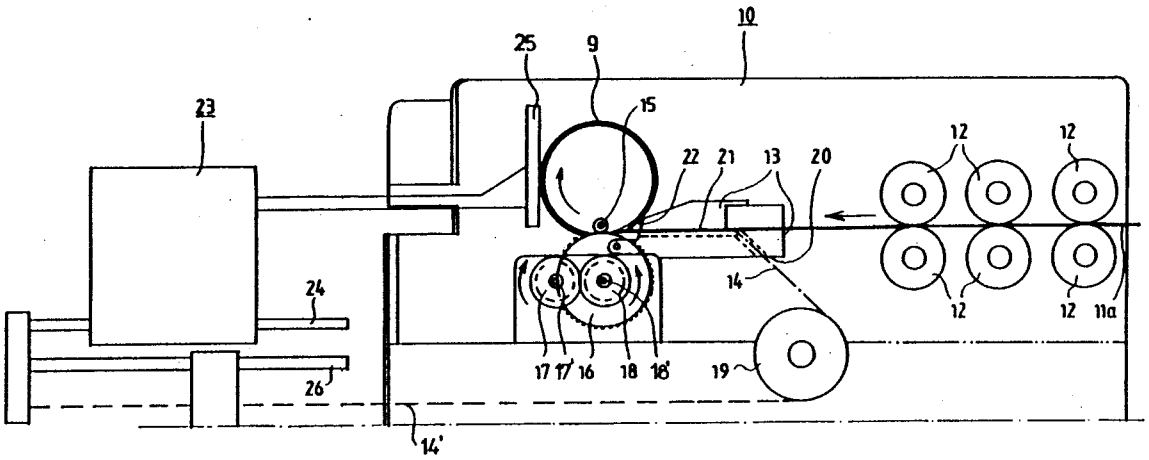
FIG. 1 shows a machine according to the invention, viewed from the side of the direction of the tubing being formed, in schematic representation.

When manufacturing straight tubes, the metal strip blank 11*a* is guided by means of the traction member 14. The traction member 14 constitutes a loop, and after the strip profile has completed one turn in the traction member loop, the seam blanks come into jointing contact with each other, and the seaming is carried out, in a way previously known, between two seaming rolls 15 and 16.

Both the seaming rolls 15, 16 and the profiling rolls 12 are driven by means of the drive means of the machine.

In order to provide sufficient space for the members required in the seaming operation, the drive shaft of the upper seaming roll 15 is adapted to pass through the machine body 10, and the drive of the lower seaming roll 16 is provided by means of gearing 17, 18. The gears 17, 18 are adapted to receive their drive power through shafts 17', 18', respectively.

Figure 2:
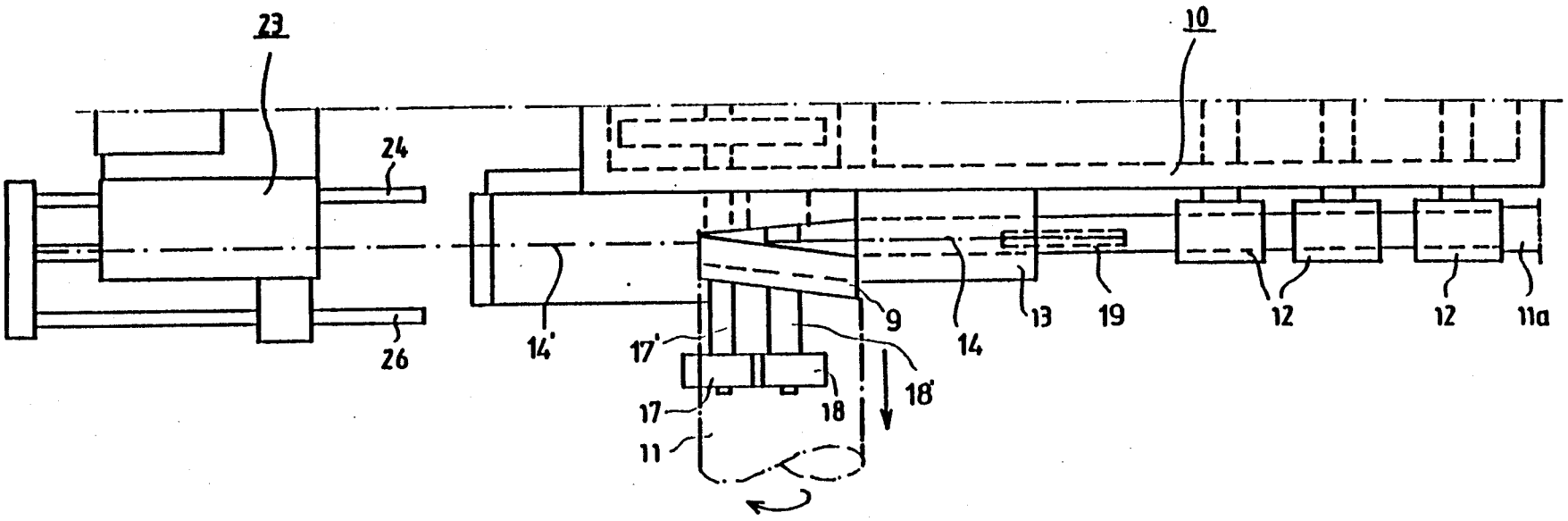
FIG. 2 is another view of the same machine, viewed from above.
Figure 3A:
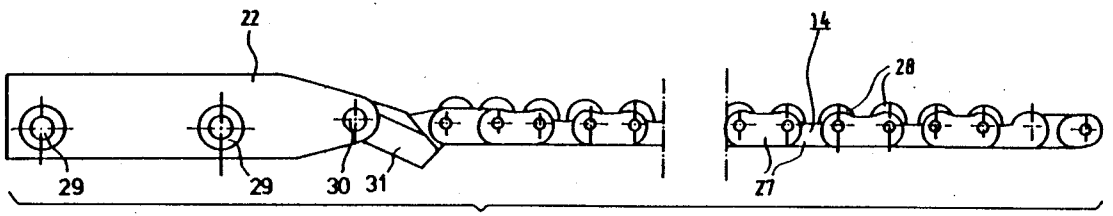
FIG. 3A shows a chain used in the machine according to the invention, viewed from the side, in schematic representation.
Figure 3B:
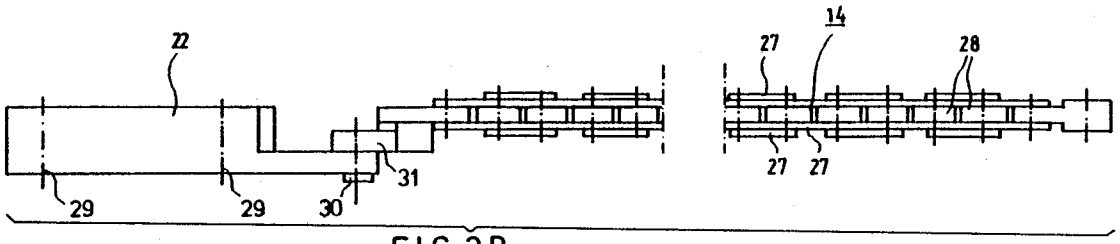
FIG. 3B shows the same as that shown in FIG. 3A, but viewed from above.

In FIGS. 1 and 2 a gearbox is designated with the reference numeral 23. The traction member 14 is connected to the gearbox, which traction member is connected at the other end thereof to a rocker 22, situated close to the guide members 13 by means of an articulated arm (FIGS. 3A and 3B) composed of a joint 30 and an arm 31. The rear edge of the metal strip blank 11*a* is moved by means of the rocker 22 so as to be at a correct point when seaming the tube 11.

The tube 11 is positioned relative to traction member 14 by means of a support 25 of the gearbox 23, i.e. in such a manner that the tube 11 is centered correctly during the seaming. The gearbox 23 moves along a slide bar 26, so that the tightening of the traction member 14 is provided by means of a rack 24 for producing, if needed, conical tubes. While the traction member 14 is pulling, the rack 24 situated in the gearbox 23 above the slide bar 26 maintains the tube 11 in its center by means of the support 25.

The moving support 25 thus enables the tube 11 to be maintained concontrically about a longitudinal central axis. By means of the gearbox 23 it is also possible to adjust the speed of seaming.

In addition, the position of the loop constituted by the traction member 14 is adjustable by means of the gearbox 23 and its rack 24.

When seaming a straight tube, the gearbox 23 remains stationary, and while changing over to producing a conical tube, the diameter is diminished by means of the traction member 14 by tightening the traction member 14 through the motion of the gearbox 23 and the rack 24 thereof.

FIG. 3 shows a chain structure suitable for use as traction member 14 as well as the rocker 22 connected with the chain structure. The traction member 14 comprises rolling members 28 and plates 27 interlinking them. The rolling members 28 are so disposed that the rolling faces are only on one side of the traction member 14. During the seaming operation these rolling members 28 are positioned against the metal strip blank 11 to be seamed, guiding and supporting it. The other side of the traction member 14 is straight, thus providing a good glide surface. In addition, during the seaming operation a lubricant is used, which serves as a cooling agent at the time, for the purpose of improving the travel of the traction member 14. A lubricating and cooling agent used, for instance, is soft potash soap liquid. The traction member 14 is made, for instance, of tool-making steel. The rocker 22 is provided with adjusting screws 29, by means of which the rear portion of the metal strip blank 11*a* is moved so as to be at a correct point for achieving the proper seaming. The portion 14' of the traction member 14, which is not used for the actual guiding of the blank of the tube 11 to be helically seamed, may also be made so as to be of a type other than the chain structure of the kind described above.

As can readily be inferred from the preceding description, the machine operates as follows:

A strip-like blank 11*a* is first guided through a set of profile rolls 12 and then through guide block 13 which guide blocks have an intermediate space for imparting positive guidance to the moving meter strip. After leaving the guide blocks, the strip is acted upon by annular rigid guidance member 9 (only used if a conical portion of a finished tube is desired) which forms the strip into a helical ring but acts upon the strip only during the forming of the first helix. Thereupon traction member 14 (formed into a loop) guides the helical ring and determines its diameter so as to form thereby a straight tube, or a tube having a narrowing, preferably conical position. If a tube with a narrowing portion is desired the diameter of the loop formed by traction member 14 must be correspondingly decreased. This decrease in diameter is accomplished by movement of gear box 23, which is attached to an end of traction member 14, along slide bar 26 such that rack 24 within gearbox 23 tightens traction member 14.

The invention has been described above with reference to only one advantageous embodiment thereof. However, it is hereby not desired to restrict the invention to this example only in any way, but, instead, numerous modifications are feasible within the inventive idea defined in the following claims.

What is claimed is:

1. A machine for manufacturing helically-seamed tubing from a strip-like profiled blank, said machine comprising;

a loop for positively guiding said strip-like profiled blank into a helical shape, said loop comprising a chain-type traction member and inside which loop said strip-like profiled blank is caused to be positively fed whereupon it assumes the shape of a tube;

a rocker;

an articulated arm connecting said rocker and one end of said traction member;

said rocker comprising at least one adjusting member for guiding a rear edge of said helically shaped strip-like profiled blank to a point of seaming;

a gearbox connected to another end of said traction member;

a slide bar on which said gearbox is mounted for movement relative thereto;

a gear member connected within said gearbox such that movement of said gearbox along said slide bar causes said gear member to pull said traction member such that said traction member can be tightened to cause the diameter of said loop to lessen such that a narrowing portion can be produced in said tube;

a support connected to said gearbox for positioning said tube for seaming; and two seaming rolls for seaming together adjacent edges of said tube.

2. The machine of claim 1, wherein said traction member comprises a flexible chain having rolling members disposed on one side of said chain for abutting said strip-like profiled blank for guiding said strip-like profiled blank, said chain on another side having a straight profile and comprising, on said another side a plurality of plates interlinking said rolling members such that said another side of said chain can move slidably.

3. The machine of claim 2, further comprising a lubricating and cooling agent for facilitating said slidable movement of said another side of said chain.

4. The machine of claim 3, wherein said lubricating and cooling agent is soft potash soap liquid.

5. The machine of claim 1, further comprising a machine body wherein said at least one adjusting member of said rocker comprises a plurality of screws such that said rocker can be positioned such that an edge of said strip-like profiled blank adjacent said machine body of said machine can be guided to said point of seaming by said traction member.

6. The machine according to claim 1, wherein said gear member connected to said gearbox is a rack.

7. The machine of claim 5, further comprising an annular, rigid positive guidance member integrally connected with said machine body for positively guiding said strip-like profiled blank toward said loop comprising a chain-type traction member.

* * * * *